US011430645B2

(12) United States Patent
Baba et al.

(10) Patent No.: US 11,430,645 B2
(45) Date of Patent: Aug. 30, 2022

(54) ELECTRON BEAM THROTTLING FOR ELECTRON CAPTURE DISSOCIATION

(71) Applicant: DH TECHNOLOGIES DEVELOPMENT PTE. LTD., Singapore (SG)

(72) Inventors: Takashi Baba, Richmond Hill (CA); Pavel Ryumin, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/284,336

(22) PCT Filed: Oct. 8, 2019

(86) PCT No.: PCT/IB2019/058558

§ 371 (c)(1),
(2) Date: Apr. 9, 2021

(87) PCT Pub. No.: WO2020/075068

PCT Pub. Date: Apr. 16, 2020

(65) Prior Publication Data

US 2021/0351026 A1 Nov. 11, 2021

Related U.S. Application Data

(60) Provisional application No. 62/743,265, filed on Oct. 9, 2018.

(51) Int. Cl.
*H01J 49/00* (2006.01)
*H01J 49/02* (2006.01)

(52) U.S. Cl.
CPC ..... *H01J 49/0054* (2013.01); *H01J 49/022* (2013.01)

(58) Field of Classification Search
CPC ..... H01J 49/0054; H01J 49/022
USPC ..... 250/281, 282, 283
See application file for complete search history.

(56) References Cited

U.S. PATENT DOCUMENTS

2008/0035841 A1* 2/2008 Ding ..... H01J 49/42 250/283
2009/0014639 A1 1/2009 Bateman
2016/0343560 A1 11/2016 Schanen
2017/0089862 A1 3/2017 Batemen

OTHER PUBLICATIONS

International Search Report and Written Opinion for PCT/IB2019/058558 dated Feb. 1, 2020.

(Continued)

*Primary Examiner* — Nicole M Ippolito

(57) ABSTRACT

In one aspect, an electron-ion reaction module, e.g., an electron capture dissociation module, for use in a mass spectrometer is disclosed, which comprises a chamber, an electron source for generating electrons and introducing the electrons into the chamber, a gate electrode positioned relative to the electron source and the chamber, and a DC voltage source operatively coupled to the gate electrode for applying control voltages to the gate electrode. The electron-ion interaction module can further include a controller operably coupled to the DC voltage source and configured for adjusting the DC voltage applied to the gate electrode to adjust flow of electrons into the chamber.

9 Claims, 12 Drawing Sheets

(56) References Cited

OTHER PUBLICATIONS

Dhan, T W et al: "Optimization of Experimental Parameters for Electron Capture Dissociation of Peptides in a Fourier Transform Mass Spectrometer", Journal of the American Society for Mass Spectrometry, Elsevier Science, Inc, US, vol. 13. No. 12 Dec. 1, 2002.

Tsybin Y O et al: "Electron Capture Dissociation Implementation Progress in Fourier Transform Ion Cyclotron Resonance Mass Spectrometry", Journal of the American Society for Mass Spectromoetry, Elsevier Science Inc., US, vol. 19, No. 6, Jun. 1, 2008.

* cited by examiner

ELECTRON BEAM THROTTLING FOR ELECTRON CAPTURE DISSOCIATION

RELATED US APPLICATIONS

The present application claims the benefit of priority from U.S. Provisional Application No. 62/743,265 filed on Oct. 9, 2018, the entire contents of which is incorporated by reference herein.

FIELD

The present teaching relate to systems and methods for electron-ion interaction in a mass spectrometer.

BACKGROUND

The present teachings are generally directed to systems and methods for electron capture dissociation suitable for use in mass spectrometry.

Tandem mass spectrometry, such as MS/MS, involves multiple stages of mass selection with ion fragmentation occurring between certain stages. One method of ion fragmentation includes electron capture dissociation (ECD). In ECD, an ion can capture one or more electrons and subsequently undergo dissociation into fragment product ions. A sufficient number of electrons is necessary for a high fragmentation yield. However, if the number of electrons in a reaction chamber is too high, it can lead to undesirable neutralization of the fragmented product ions as well as their internal fragmentation, which can significantly decrease the signal-to-noise (S/N) ratio. Further, the electron capture efficiency is proportional to the square of an ion charge. Consequently, the optimal conditions for electron capture can be different for ions with different charge states. Further, the optimal conditions for electron capture can vary depending on the total number of ions in the reaction device. Thus, it is desirable to have methods and systems for adjusting the electron irradiation based on properties of a compound under study.

One conventional way of adjusting the electron irradiation is to modulate the temperature of an electron emission filament by changing the current flowing through it. But such an approach can be slow, non-linear, and can exhibit variability from one instrument to another due to the wear of the filament emission surface.

Accordingly, there is a need for improved methods and systems for achieving electron-ion interaction in a mass spectrometer, and more particularly, for improved methods and systems for electron capture dissociation.

SUMMARY

In one aspect, an electron-ion reaction module, e.g., an electron capture dissociation module, for use in a mass spectrometer is disclosed, which comprises a chamber, an electron source for generating electrons and introducing the electrons into the chamber, a gate electrode positioned relative to the electron source and the chamber, and a DC voltage source operatively coupled to the gate electrode for applying control voltages to the gate electrode. The electron-ion interaction module can further include a controller operably coupled to the DC voltage source and configured for adjusting the DC voltage applied to the gate electrode to adjust flow of electrons into the chamber.

In some embodiments, the controller can adjust the DC voltage applied to the gate electrode by switching the DC voltage between a plurality of discrete voltage levels. By way of example, one of said discrete voltage levels can correspond to a state of the gate (herein "on-state") during which the gate allows introduction of the electrons into said chamber and another one of said discrete voltage levels can correspond to another state of said gate (herein "off-state") during which the gate inhibits introduction of the electrons into said chamber. The controller can adjust the periodicity of the "on" and "off" voltages so as to adjust the electron current introduced into the chamber. In some embodiments, the discrete voltage levels are in a range of 0 volt to about 100 volts. In some such embodiments, the application of the "on" and "off" voltages to the gate electrode can switch the electron current between a vanishing value and a value up to about 5 μA.

In some embodiments, the controller can switch the DC voltage applied to the gate electrode between the discrete levels at a switching frequency, for example, in a range of about 100 Hz to about 100 kHz.

In some embodiments, the controller can adjust the DC voltage applied to the gate electrode so as to achieve at least about 50% fragmentation of the ions in the chamber that are exposed to the electrons.

In some embodiments, the electron-ion reaction module can include a first inlet port for receiving ions and a second inlet port for receiving electrons. In some such embodiments, the gate electrode of the electron-ion interaction module is positioned in proximity of the inlet port for introducing electrons into the chamber.

In a related aspect, a mass spectrometer is disclosed, which comprises an ion source for generating ions, and an electron-ion reaction module disposed downstream of said ion source for receiving said ions, where the electron-ion reaction module comprises a chamber, an electron source for generating electrons and introducing said electrons into the chamber, and a gate electrode positioned relative to the electron source and the chamber for modulating electron current entering the chamber. The electron-ion reaction module further comprises a DC voltage source that is operatively coupled to said gate electrode for applying control voltages to the gate electrode, and a controller that is operably coupled to said DC voltage source and is configured for adjusting the DC voltage applied to the gate electrode so as to modulate electron current introduced into the chamber.

In some embodiments of the above mass spectrometer, the controller can adjust the DC voltage applied to the gate electrode by switching the DC voltage between a plurality of discrete voltage levels. By way of example, one of said discrete voltage levels can correspond to a state of the gate (herein "on-state") during which the gate allows introduction of electrons into said chamber and another one of said discrete voltage levels can correspond to another state of the gate (herein "off-state") during which the gate inhibits introduction of the electrons into the chamber. The controller can adjust the periodicity of the "on" and "off" voltages so as to adjust electron current introduced into the chamber. In some embodiments, the discrete voltage levels can be in a range of 0 and 100 volts.

In some embodiments of the above mass spectrometer, the controller switches the DC voltage applied to the gate electrode between the discrete levels at a switching frequency, for example, in a range of about 100 Hz to about 100 kHz.

In some embodiments, the controller can adjust the DC voltage applied to the gate electrode so as to cause fragmentation of at least about 50% of the ions in the chamber, e.g., via electron capture dissociation.

In some embodiments of the above mass spectrometer, the electron-ion interaction module can include a first inlet port for receiving ions and a second inlet port for receiving electrons. In some such embodiments, the gate electrode of the electron source can be positioned in proximity of the second inlet port of the module.

In a related aspect, a method for introducing electrons into an electron-ion interaction module is disclosed, which comprises adjusting a DC voltage applied to a gate electrode disposed between an electron source and an inlet of said electron-ion reaction module configured for receiving electrons generated by said electron source by switching said gate voltage between a plurality of discrete voltage levels at a frequency of at least about 100 Hz, e.g., in a range of about 100 Hz to about 100 kHz, so as to modulate electron current entering said ion-electron interaction module. The method can further include introducing a plurality of ions into said electron-ion interaction module such that the ions can interact with the electrons. By way of example, the ions can capture one or more of the electrons and consequently undergo fragmentation.

In a related aspect, a method for selecting the periodicity of a plurality of "on" and "off" voltages applied to the gate electrode of an electron-ion interaction module according to the present teachings is disclosed, which comprises obtaining a mass spectrum of one or more ionic species of interest in a low (or no) fragmentation mode, e.g., in absence of electron-ion interaction or very low electron-ion interaction, such as electron capture dissociation. This can be followed by obtaining another mass spectrum of those ionic species in a high fragmentation mode, i.e., while subjecting the ions to electron-ion interaction, e.g., electron capture dissociation. By way of example, the switch between the low and the high fragmentation mode can be achieved by application of an arbitrary periodicity of "on" and "off" voltages to the gate electrode of the module. A comparison of the two mass spectra can provide an estimate of the fraction of the ions that have undergone fragmentation due to electron-ion interaction. Known calibration curves can then be used to estimate the periodicity of the "on" and "off" voltages that would be required to cause fragmentation of at least about 50% of the ions via electron-ion interaction, e.g., electron capture dissociation, in the module.

In a related aspect, a method for selecting the duty cycle of the "on" and "off" voltages applied to the gate electrode of an ion-electron interaction module according to the present teachings can include obtaining a mass spectrum of a sample of interest to identify ionic species contained therein. Subsequently, calibration curves related to fragmentation of those ionic species due to electron capture dissociation can be used to determine a desired periodicity of the "on" and "off" voltages applied to the gate electrode of the module, e.g., a periodicity that would result in fragmentation of at least about 50% of the ions due to electron capture dissociation.

In a related aspect, a method of processing ions in an electron-ion reaction module is disclosed, which comprises modulating an electron current applied to said electron-ion reaction module so as to switch electron-ion interaction within said module between a low fragmentation and a high fragmentation regime, and acquiring a mass spectrum of ions for each of said low and high fragmentation regimes. By way of example, the step of modulating the electron current can comprise switching the electron current between an "on" and an "off" state. In some embodiments, the switching frequency can be in a range of about 100 Hz to about 100 kHz.

In a related aspect, an electron-ion reaction module for use in a mass spectrometer is disclosed, which comprises a chamber having an input port and an exit port, an electron-emitting filament disposed in said chamber, e.g., in proximity of the input port, for generating electrons in response to application of a DC voltage thereto, a DC voltage source for applying a DC voltage to said filament, and a controller operably coupled to said DC voltage source and configured to adjust the DC voltage applied to the filament so as to adjust electron current within the chamber.

In some embodiments, the controller adjusts the DC voltage applied to the filament by switching the DC voltage between a plurality of discrete voltage levels. By way of example, in some such embodiments, the controller adjusts the applied voltage periodically between "on" and "off" states. In some embodiments, the controller switches the applied DC voltage between a plurality of discrete levels at a duty cycle in a range of about 1 to about 100.

In some embodiments, the electron-ion reaction module can further include a multipole rod set, e.g., a quadrupole rod set, positioned in the chamber for providing radial confinement of ions within the chamber.

In some embodiments, an electron-ion reaction module can include a chamber in which one or more multipole rod sets are disposed. The reaction module can include an opening that can receive electrons generated by a filament positioned outside the multipole rod set(s), e.g., a quadrupole rod set, and in proximity of said opening. A DC voltage applied to the filament can be switched between a plurality of discrete levels so as to adjust the electron flow into the multipole rod set(s). In some such embodiments, an electrode can be positioned between the filament and said opening and a DC voltage applied to the electrode can be modulated to modulate the flow of electrons into the multipole rod set(s).

Further understanding of various aspects of the present teachings can be obtained by reference to the following detailed description in conjunction with the associated drawings, which are described briefly below.

DETAILED DESCRIPTION

The present teachings generally relate to an electron-ion interaction module (herein also referred to as electron-ion reaction module) for use in a mass spectrometer, which includes a plurality of quadrupole rods sets, e.g., two quadrupole rods sets, that are positioned in tandem relative to one another with one or more gaps separating them. The module can further include an electron source having an element for generating electrons, e.g., a heated filament, and a gate electrode that can modulate the flow of the electrons. For example, in some embodiments, a DC voltage source under control of a controller can apply "on" and "off" voltages to the gate electrode to modulate the flow of electrons from the electron source to the electron-ion interaction module. Although in the following embodiments the electron-ion interaction module includes quadrupole rods sets, in other embodiments it can include other multi-pole rods sets, such as hexagonal or octagonal. Further, in many of the following embodiments, the electron-ion interaction module can be an electron capture dissociation module. However, the present teachings are not limited to electron capture dissociation modules and can be applied to other electron-ion interaction modules, such as electron impact dissociation (EID), electron impact excitation of ions from organics (EIEIO), and electron detachment dissociation (EDD).

Figure 1A:
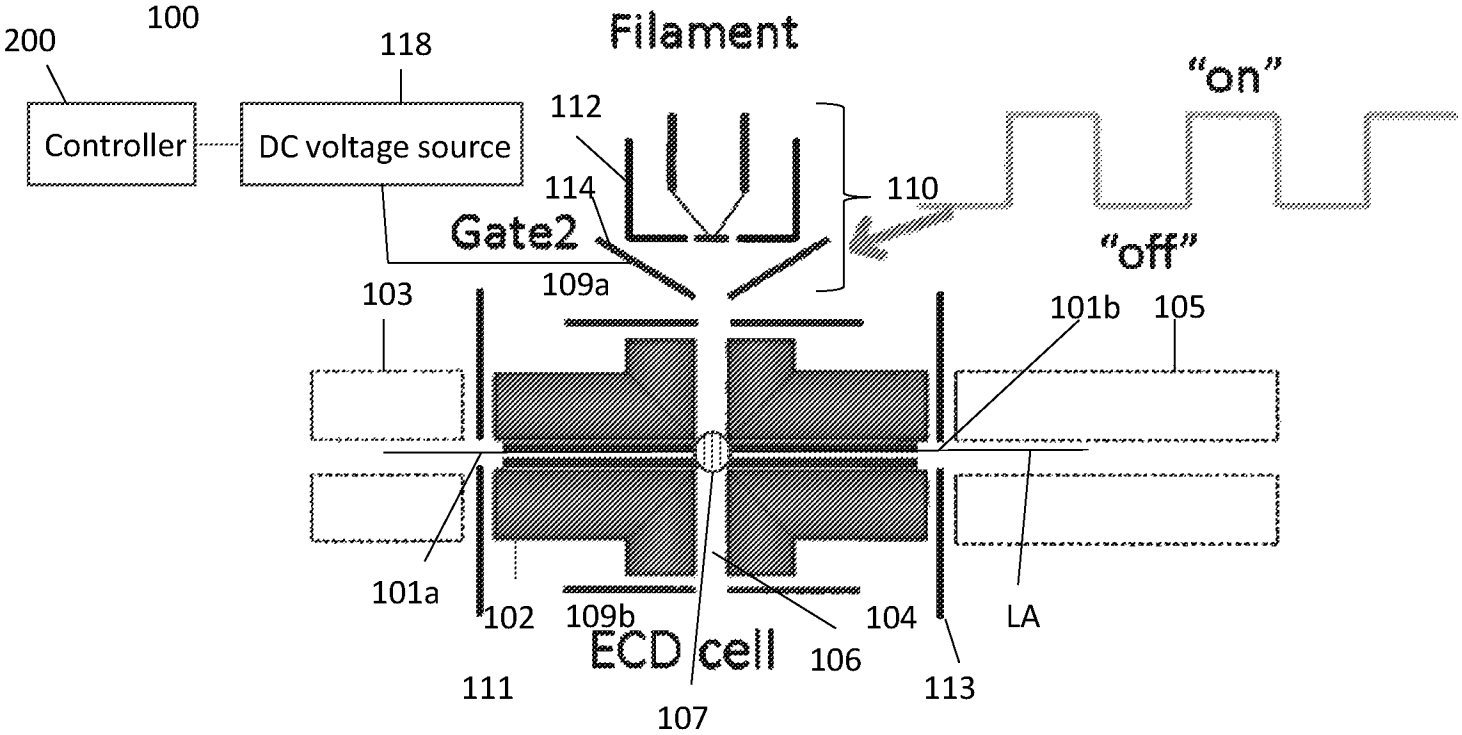
FIG. 1A schematically depicts an electron capture dissociation module according to an embodiment of the present teachings comprising multiple quadrupole rod sets.
Figure 1B:
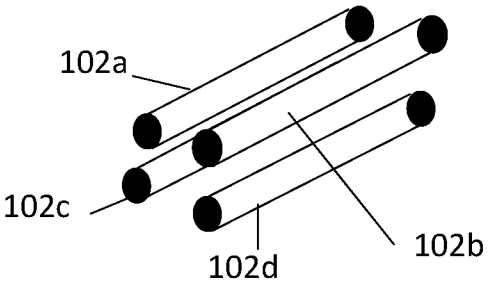
FIG. 1B is a schematic perspective view of the electrodes of one of the quadrupole rod sets employed in the ECD module depicted in FIG. 1A.

FIGS. 1A and 1B schematically depict an electron capture dissociation (ECD) module 100 according to an embodiment of the present teachings, which is suitable for use in a mass spectrometer. The ECD module 100 includes two quadrupole rods sets 102 and 104 that are positioned in tandem relative to one another so that they share a common longitudinal axis (LA). A gap 106 separates the two quadrupole rods sets. Each quadrupole rod set includes four rods arranged in a quadrupole configuration. By way of example, FIG. 1B schematically depicts that quadrupole rod set 102 includes four rods 102*a*, 102*b*, 102*c*, and 102*d*, which are arranged around the longitudinal axis (LA) in a quadrupole configuration. The other quadrupole rod set includes a similar arrangement of rods (FIG. 1A shows only two of the rods of each quadrupole rod set).

The quadrupole rods sets provide an input port 101*a* for receiving ions from an upstream component, e.g., an RF/DC filter 103, and an exit port 101*b* through which the ions exit the quadrupole rods sets to be introduced to downstream components, e.g., a mass analyzer 105. A volume 107 located substantially between the quadrupole rods sets provides an interaction volume in which the ions can interact with the electrons supplied by an electron source, as discussed in more detail below. In this embodiment, two electrodes 111 and 113 can be optionally positioned in proximity of the input and the output ports of the rods sets such that application of appropriate voltages thereto can help axially confine the ions within the interaction module.

Figure 2:
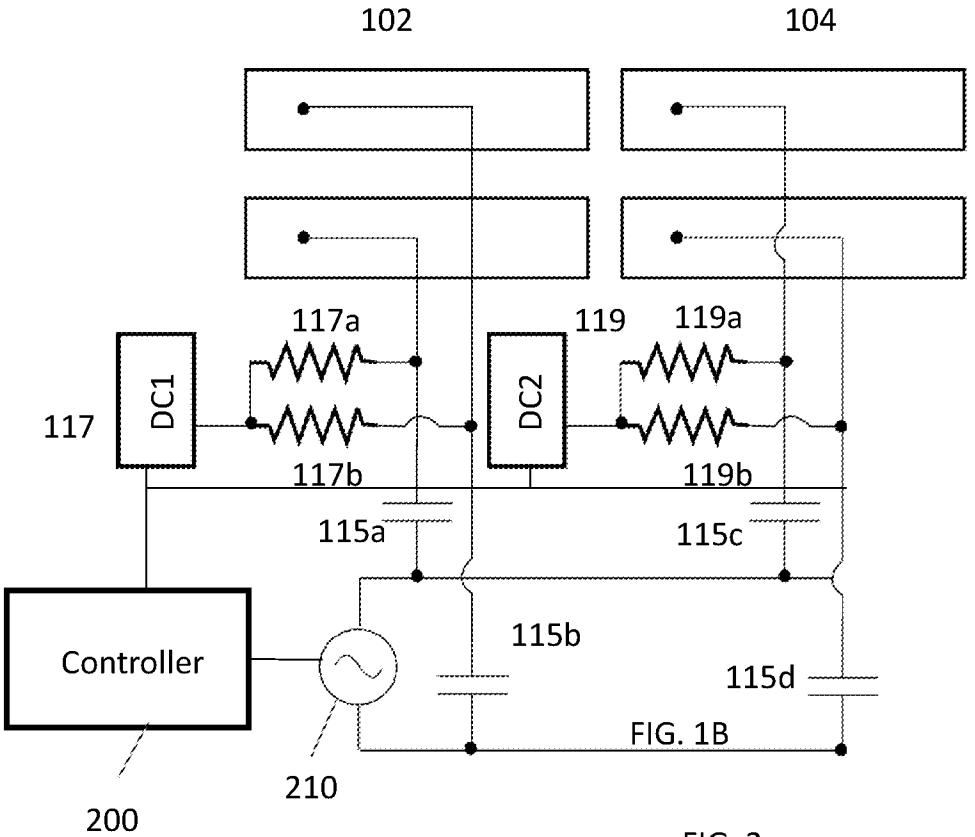

As shown in FIG. 2, at least one radiofrequency (RF) source 210 is capacitively coupled via capacitors 115*a*, 115*b*, 115*c*, 115*d* to the rods of the quadrupole rod sets to apply RF voltages thereto In some embodiments, the RF voltages applied to the rods of the quadrupole rod sets can have a frequency, for example, in a range of about 200 kHz and 10 MHz and an amplitude in a range of about 100 V to about 10 kV.

Further, in this embodiment, a plurality of DC voltage sources 117, 119 are coupled electrically to the rods of the rod sets via resistors 117*a*/117*b*, 119*a*/119*b*. The DC voltage sources can apply DC voltages to the rods of the quadrupole rod sets, for example, to trap ions within an interaction volume of the rod sets and/or modulate the energy of the electrons within the interaction module. In some embodiments, the DC voltages applied to the rods of the rod sets can be, for example, in a range of about 0 and about 300 volts. Further, DC voltages can be applied to the electrodes 111 and 113 to help trap ions within the electron-ion interaction module.

A controller 200 in communication with the RF source 210 and the DC voltage sources can control the application of the RF and/or DC voltages to the rods of the quadrupole rod sets (and the electrodes 111 and 113). For example, the controller 200 can control the application of RF voltages to the rods of the quadrupole rod sets such that the phase of a voltage applied to any rod of the rod sets is opposite to the phase of the RF voltage applied to a respective rod of a neighboring rod set.

Figure 3:
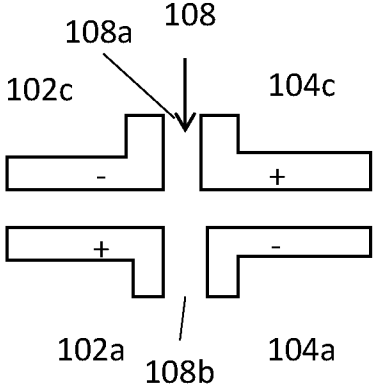
FIG. 3 is a partial schematic view of the quadrupole rods sets employed in the ECD module depicted in FIG. 1A, illustrating that the phase of an RF voltage applied at any given time to the rods of one of the quadrupole rod sets is opposite to that of the RF voltage applied to the respective rods of the other quadrupole rod set.

For example, with reference again to FIG. 1A as well as FIG. 3, at a given moment in time, when the voltage applied to rod 102*a* of the quadrupole rod set 102 has a positive polarity, the voltage applied to rod 104*a* of the quadrupole rod set 104, which is placed along the axial extension of the rod 102*a* and separated therefrom by the gap 106, has a negative polarity. Further, when the voltage applied to rod 102*c* of the quadrupole rod set 102 has a negative polarity, the voltage applied to the respective rod 104*c* of the quadrupole rod set 104 has a positive polarity. Similar pattern of opposite polarities can be observed in FIG. 3 for the respective rods of the other quadrupole rod sets.

In this embodiment, each quadrupole rod has an L-shaped configuration such that the gap 106 between the two quadrupole rods sets forms a passageway 108 that extends between two openings 108*a* and 108*b*. Two electrodes 109*a* and 109*b* positioned, respectively, in proximity of the openings 108*a* and 108*b* and to which DC voltages can be applied, e.g., under the control of the controller 200, can advantageously inhibit the ions from exiting the quadrupole rods sets via the openings 108*a* and 108*b*.

Figure 1C:
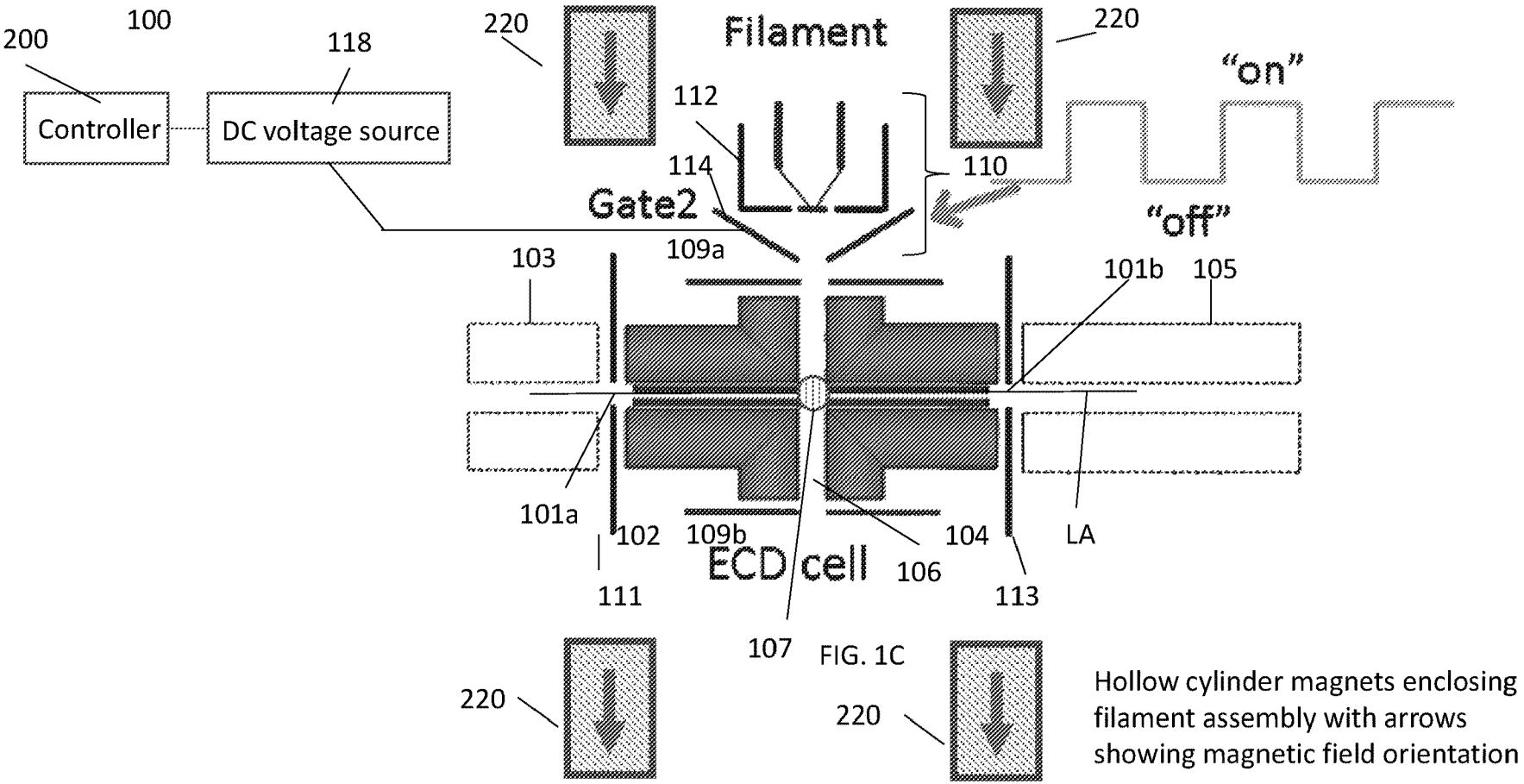
FIG. 1C is a schematic view of an embodiment of an electron capture dissociation module, which includes a plurality of magnets for superimposing a magnetic field on the RF confinement field, FIG. 2 a partial schematic view of the electron-ion interaction module of FIG. 1A depicting the application of RF and DC voltages to the rods of the rod sets.

The ECD module 100 further includes an electron source 110 that is positioned relative to the quadrupole rods sets so as to introduce the electrons via the input opening 108*a* into the interaction volume between the two quadrupole rods sets. The electrons travel through a portion of the passageway 108 to reach the ion-electron interaction volume, positioned approximately in the vicinity of the middle of the passageway 108 in this embodiment, in which the ions can interact with the electrons, e.g., to capture one or more electrons and consequently undergo fragmentation. As shown in FIG. 1C, in some embodiments, permanent or electromagnetic magnets 220 can be employed to superimpose a magnetic field on the RF confinement field to ensure that the electrons travelling into the interaction volume are not distorted by the RF field.

The electron source 110 includes a filament 112 that can be heated to generate electrons. A gate electrode 114 positioned in front of the filament can modulate the electron current in a manner discussed in more detail below. In particular, the application of alternating "on" and "off" voltages to the gate electrode 114 can alternatingly allow and inhibit the passage of electrons emitted by the filament 112 into the space between the quadrupole rods sets via the opening 108*a*. In other words, in the "on" state, the gate electrode is in an open state and hence electrons can pass through the electrode opening to reach the input port 108*a*, and in the "off" state, the gate electrode is in a closed state and hence inhibits the passage of the electrons to the input opening 108*a*.

As shown in FIG. 1A, the controller 200 can control a DC voltage source 118, which is electrically coupled to the gate electrode 114, to modulate the voltage applied to the gate electrode. In particular, the controller 200 can adjust the duty cycle of the open and closed states of the gate electrode to achieve an optimal electron capture dissociation condition for a charged species of interest. By way of example, in some embodiments, the duty cycle can be in a range of about 1% to about 100%. In some embodiments, such a range of duty cycle can provide flexibility in the modulation of the electron current, e.g., the electron current can exhibit a variation characterized by a factor as high as about 100. For example, in some application, the duty cycle can be adjusted to obtain an electron current in a range of about 1 nA (nano-amp) to about 100 nA, and in some other applications, the duty cycle can be adjusted to obtain an electron current in a range of about 100 nA to about 10 μA (micro-amp).

For example, as noted above, the electron capture efficiency is proportional to the square of the charge of an ion. As such, as the charge of an ion increases the current needed for efficient capture of electrons by that ion decreases. In this embodiment, the controller 200 can accordingly adjust the duty cycle of the on/off voltages applied to the gate electrode to ensure an optimal interaction between the electrons and the ion.

Figure 4A:
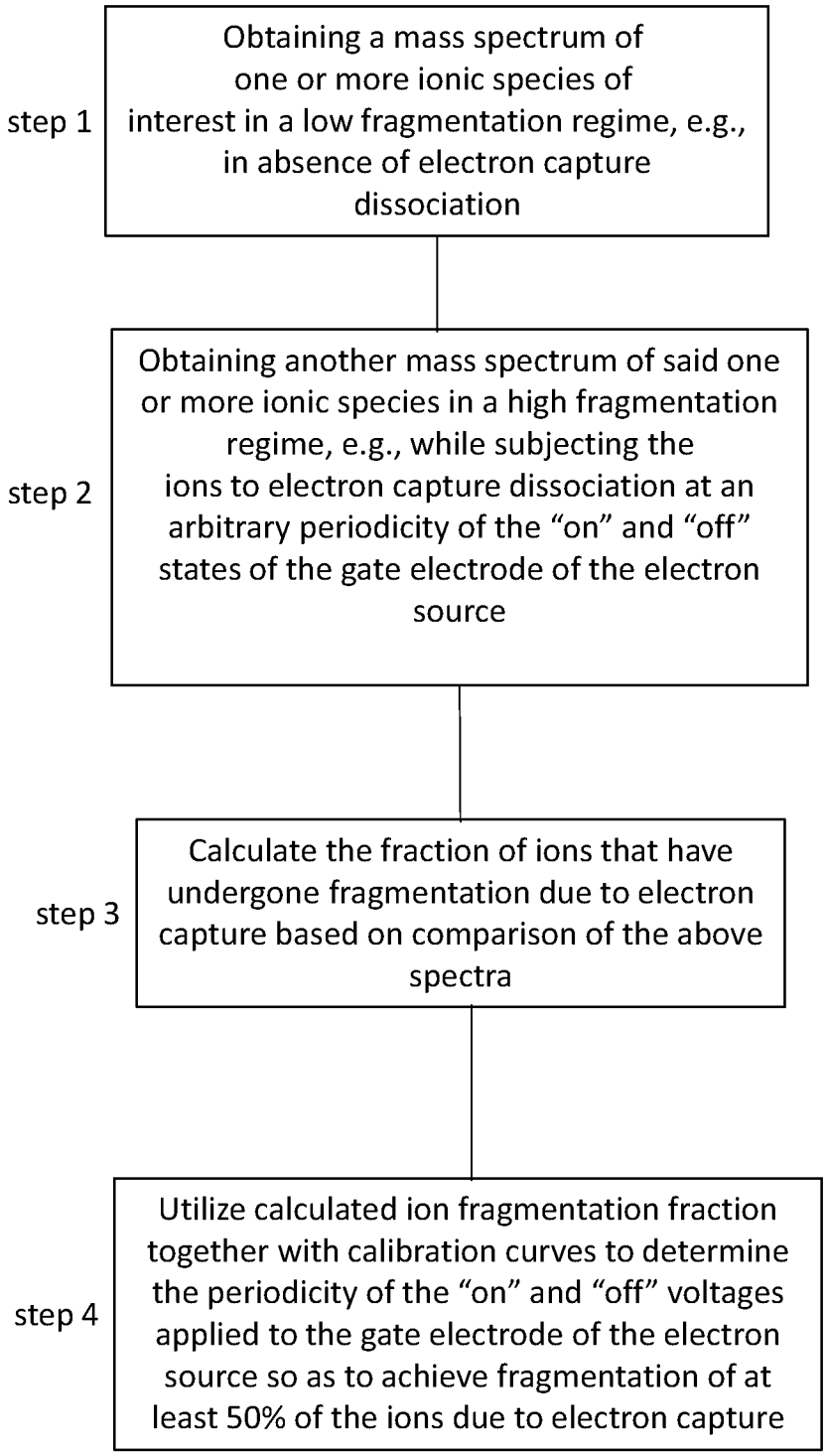
FIG. 4A is a flow chart depicting various steps in a method according to an embodiment for selecting the periodicity of the "on" and "off" voltages applied to the gate electrode of an electron-ion interaction module according to the present teachings.

More specifically, with reference to FIG. 4A, in some embodiments, a method for selecting a duty cycle of the on/off voltages applied to the gate electrode can include obtaining a mass spectrum of one or more ionic species of interest in a low (or no) fragmentation regime, e.g., in absence of electron capture dissociation (step 1). Subsequently, another mass spectrum of the one or more ionic species can be obtained in a high fragmentation regime, e.g., while subjecting the ions to electron-capture dissociation (step 2). By way of example, the switch between the low fragmentation regime and the high fragmentation regime can be accomplished at an arbitrary duty cycle of the "on" and "off" voltages applied to the gate electrode of the electron source (step 2). A comparison of the two mass spectra can provide the fraction of the ions that have undergone fragmentation (step 3). In some embodiments, calibration techniques can be employed to obtain an estimate of the fraction of the ions that have undergone fragmentation. More generally, calibration techniques can be employed in different aspects of the process. For example, this may include the efficiency of electron capture on charge state. In such a case, an optimal electron flux can be found for a model analyte acquired under similar conditions as the target analyte. This optimal electron exposure rate can be extrapolated to different analytes considering electron capture efficiency dependency on analyte charge state. In other embodiments, calibration curves can be employed for different ion loading into ECD cell and then optimal electron exposure for target analyte is extrapolated using relevant calibration value (i.e., the one obtained for a similar number of ion species in the trap) for model analyte and electron capture efficiency on analyte charge. Examples of suitable calibration processes can be found in an article entitled "Ion/Ion Proton-Transfer Kinetics: Implications for Analysis of Ions Derived from Electrospray in Protein Mixture," published in Anal. Chem. 1998, 70(6), pp. 1198-1202, which is herein incorporated by reference in its entirety.

Figure 4B:
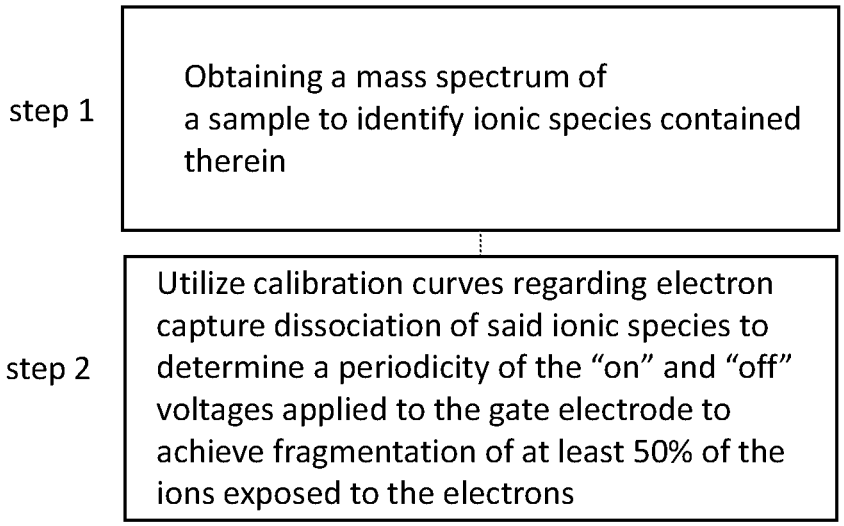
FIG. 4B is a flow chart depicting various steps in a method according to another embodiment for selecting the periodicity of the "on" and "off" voltage applied to the gate electrode of an electron-ion interaction module according to the present teachings, FIG. 5 schematically depicts a mass spectrometer in which an ECD module according to the present teachings is incorporated, FIG. 6A schematically depicts an ECD module according to an embodiment in which a DC voltage applied to an electron-emitting filament is modulated between a plurality of discrete levels so as to modulate electron current within the module, FIG. 6B schematically depicts an ECD module according to another embodiment, FIGS. 7A and B shows ECD spectra of Neurotensin obtained using an ECD module according to the present teachings with 20% and 80% electron transmission.

With reference to the flow chart of FIG. 4B, in another embodiment, a method for selecting a duty cycle of the on/off voltages applied to the gate electrode can include obtaining a mass spectrum of a sample of interest to identify ionic species contained therein (step 1). Subsequently, previously-obtained calibration data regarding electron capture dissociation of those ionic species can be used to adjust the duty cycle of the on/off voltages applied to the gate electrode.

Figure 5:
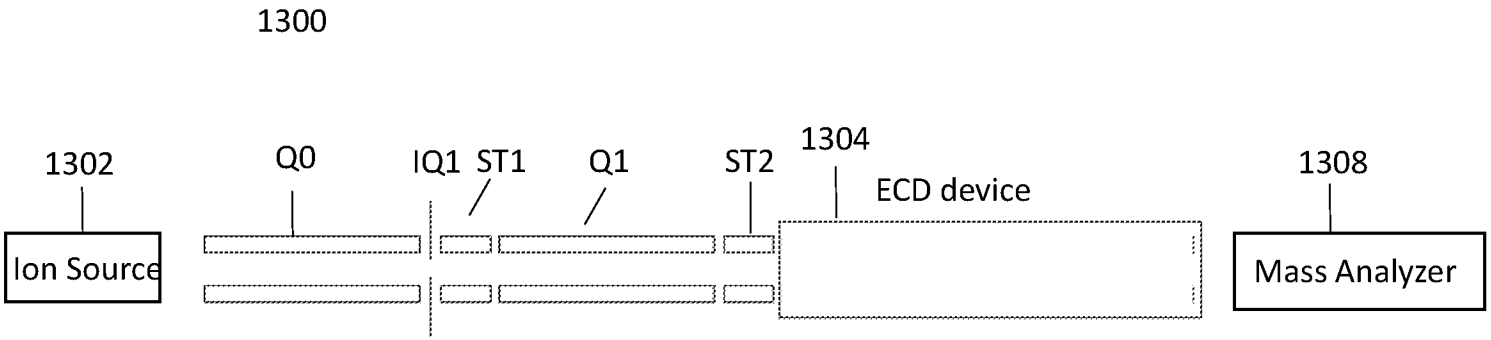

An electron capture dissociation module according to the present teachings can be incorporated in a variety of mass spectrometers. By way of example, FIG. 5 schematically depicts a mass spectrometer 1300 that includes an ion source 1302 for generating ions. The ion source can be separated from the downstream section of the spectrometer by a curtain chamber (not shown) in which an orifice plate (not shown) is disposed, which provides an orifice through which the ions generated by the ion source can enter the downstream section. In this embodiment, an RF ion guide (Q0) can be used to capture and focus the ions using a combination of gas dynamics and radio frequency fields. The ion guide Q0 delivers the ions via a lens IQ1 and stubby ST1 to a downstream quadrupole mass analyzer Q1, which can be situated in a vacuum chamber that can be evacuated to a pressure that can be maintained lower than that of the chamber in which RF ion guide is disposed. By way of non-limiting example, the vacuum chamber containing Q1 can be maintained at a pressure less than about $1\times10^{-4}$ Torr (e.g., about $5\times10^{-5}$ Torr), though other pressures can be used for this or for other purposes.

As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, in some embodiments, the quadrupole rod set Q1 can be configured as an ion trap. In some aspects, the ions can be Mass-Selective-Axially Ejected from the Q1 ion trap in a manner described by Hager in "*A new Linear ion trap mass spectrometer*," Rapid Commun. Mass Spectro. 2002; 16: 512-526.

Ions passing through the quadrupole rod set Q1 can pass through the stubby ST2 to enter an electron-capture dissociation cell 1304 according to the present teachings, such as that depicted in FIG. 1A. In this embodiment, the electron-capture dissociation cell 1304 can include two quadrupole rods sets that are disposed in tandem with a gap separating them and an electron source for generating electrons and introducing those electrons into an ion-electron interaction volume. Similar to the embodiments of electron-ion interaction modules discussed above, a controller (not shown in this figure) in communication with an RF source (also not shown in this figure) controls the application of the RF voltages to the rods of the quadrupole rod sets such that an RF voltage applied to a rod of any of the quadrupole rod sets has an opposite phase relative to an RF voltage applied to a respective rod of an adjacent quadrupole rod set. Further, the controller can control a DC voltage source that can apply a plurality of "on" and "off" voltages to the gate electrode of the ion source for modulating the electron current to be introduced into the ion-electron interaction volume. The interaction of the ions with the electrons, e.g., via electron capture, can result in the fragmentation of at least a portion of the ions resulting in product ions which can be analyzed in mass analyzer 1308.

Figure 6A:
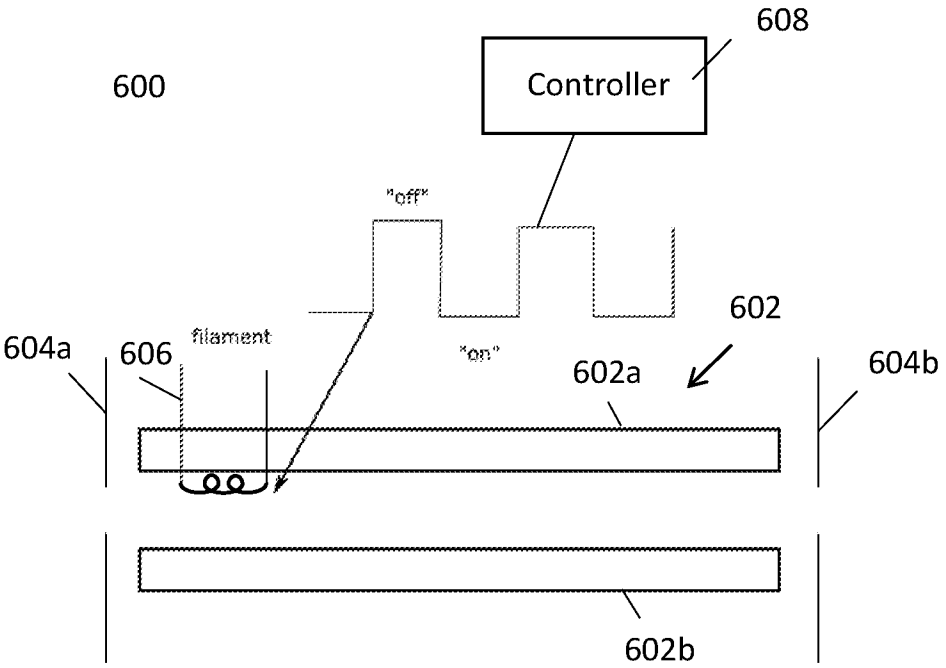

FIG. 6A schematically depicts another embodiment of an electron-ion reaction module 600 in which the electron current can be adjusted. More specifically, the electron-ion reaction module 600 incudes a quadrupole rod set 602 disposed in a chamber (not shown), which includes four rods that are arranged in a quadrupole configuration (only two of the rods 602*a* and 602*b* are depicted in FIG. 6A). Application of RF/DC voltages to the rods can provide radial trapping of ions within the space between the rods. In addition, two electrodes 604*a* and 604*b* are positioned in proximity of the entrance and the exit ports of the quadrupole rod set, respectively. Application of DC voltage(s) to at least one of the electrodes 604*a*/604*b* can allow axial confinement of the ions within the quadrupole rod set. In this embodiment, a filament 606 is positioned in the space between the rods of the quadrupole rod set, and preferably in proximity of the entrance port of the quadrupole rod set. A DC voltage can be applied to the filament to cause heating thereof, thereby causing the filament to emit electrons. The electrons emitted by the filament can interact with ions introduced into the space between the quadrupole rods sets via its input port.

In this embodiment, the DC voltage applied to the filament 606 can be adjusted so as to modify an electron current generated by the filament. By way of example, in this embodiment, a controller 608 can adjust the DC voltage applied to the filament 606 by switching it between two or more discrete voltage levels. More specifically, in this embodiment, the controller 608 switches the DC voltage applied to the filament 606 between an "on" and an "off" state to modulate the electrons emitted from the filament, thereby modulating the electron current within the quadrupole rod set. The duty cycle of the modulations can be, for example, in a range of about 1 to about 100%.

Figure 6B:
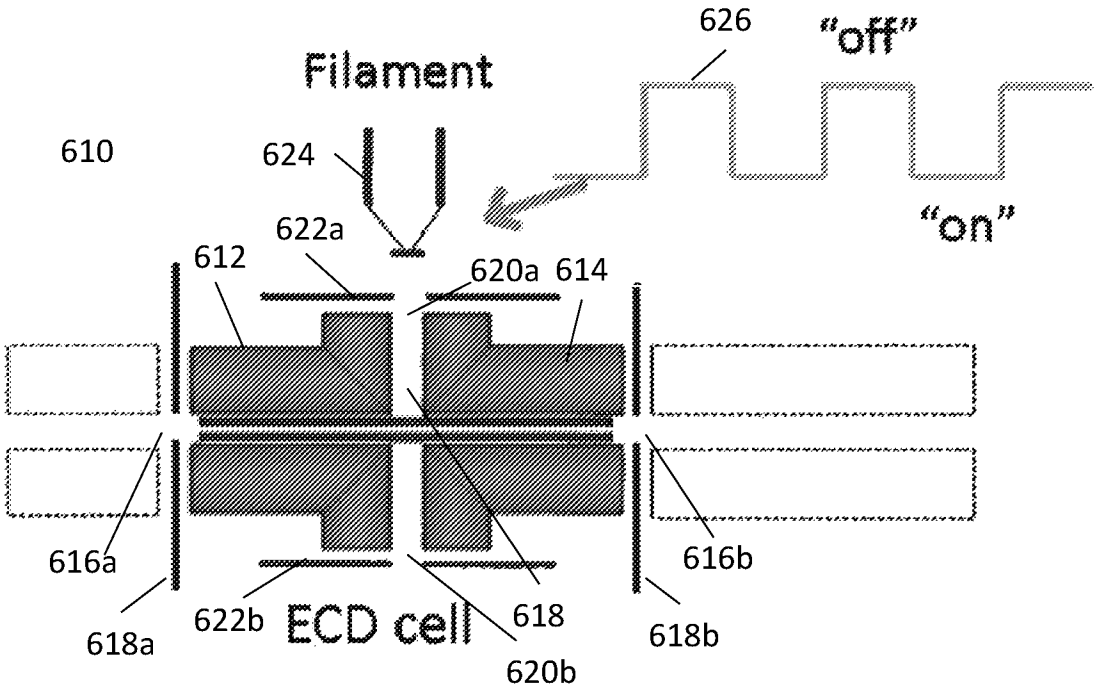

In some embodiments, the filament 606 can be positioned outside the quadrupole rod set and in proximity of an entrance port thereof and a DC voltage applied to the filament and/or electrodes positioned in proximity of the entrance and/or exit ports of the quadrupole rod set can be modulated so as to modulate electron flow through the quadrupole rod set. By way of example, FIG. 6B schematically depicts an electron-ion reaction module 610 according to such an embodiment. Similar to the embodiment depicted in FIGS. 1A and 1B, the electron-ion reaction module 610 includes two quadrupole rod sets 612 and 614 that are positioned in tandem relative to one another such that a gap separates the two quadrupole rod sets. The quadrupole rod sets include an input port 616*a* for receiving ions and an exit port 616*b* through which ions exit the quadrupole rod sets. Two electrodes 618*a* and 618*b* are positioned at the proximity of the input and output ports 616*a* and 616*b* of the quadrupole rod sets, respectively, such that application of appropriate voltages thereto can help axially confine the ions within an interaction volume associated with the quadrupole rod sets.

With continued reference to FIG. 6B, the gap between the two quadrupole rod sets forms a passageway 618 that extends between an opening 620*a* to another opening 620*b*. Two electrodes 622*a* and 622*b* are positioned in proximity of the openings 620*a* and 620*b*, respectively. A filament 624 is positioned in proximity of the opening 620*a*, where application of a DC bias voltage to the filament can cause the filament to emit electrons. The DC bias voltage applied to the filament can be switched between a plurality of discrete levels so as to modulate flow of electrons into the quadrupole rod sets. Specifically, in this embodiment, a DC bias voltage 626 applied to the filament can be switched periodically between "on" and "off" states to modulate flow of electrons into the quadrupole rod sets. Alternatively or in addition, DC voltages applied to the electrodes 622*a* and/or 622*b* can be switched between a plurality of discrete levels, e.g., switched between "on" and "off" states, to modulate the flow of electrons into the quadrupole rod sets.

The following Examples are provided for further elucidation of various aspects of the present teachings and are provided only for illustrative purposes.

EXAMPLES

An ECD module according to the present teachings as described above was incorporated in a QqToF (tandem quadrupole time-of-flight mass analyzer) mass spectrometer marketed by Sciex. A mixture of Neurotensin and Ubiquitin was infused into the mass spectrometer. $[M+3H]^{3+}$ and $[M+10H]^{10+}$ precursor ions were selected for Neurotensin and Ubiquitin, respectively. The electron current of the ECD module was optimized for the Neurotensin [M+3H]' precursor at maximum transmission. Two mass spectra were acquired for each analyte. In one acquisition, the duty cycle of the on/off voltages applied to the gate electrode of the ECD module was selected for 80% electron transmission and in another acquisition, the duty cycle was selected for 20% electron transmission.

Figure 7A:
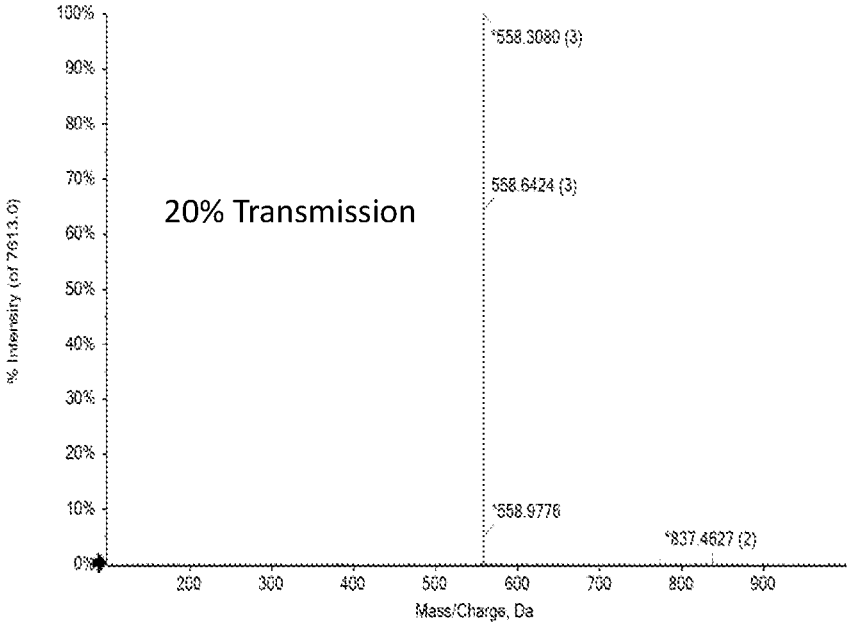
Figure 7B:
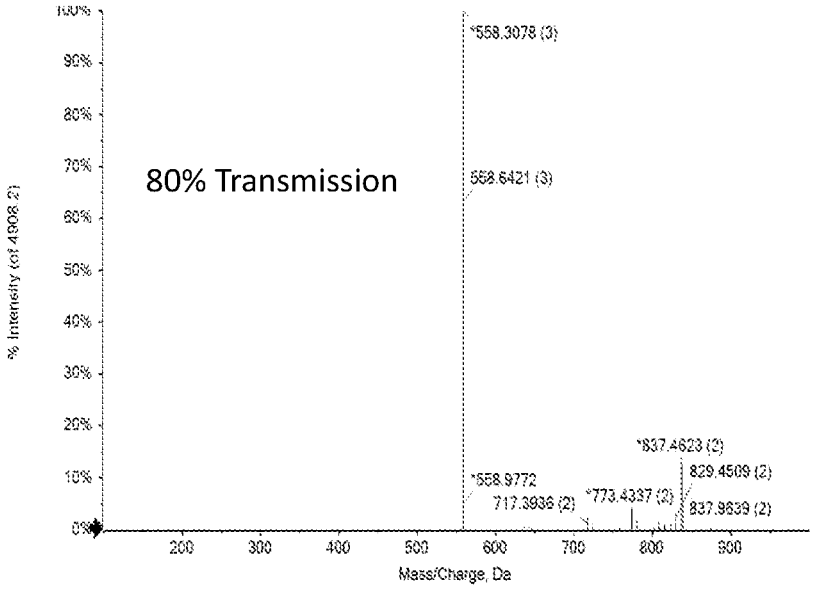

FIGS. 7A and B shows the ECD spectra of Neurotensin obtained under the same experimental conditions except for electron transmission at the gate electrode of ECD, where for one spectrum the electron transmission was 80% and for the other spectrum the electron transmission was 20%. In this case, the higher electron transmission, i.e., 80%, yields better ion fragmentation.

Figure 8A:
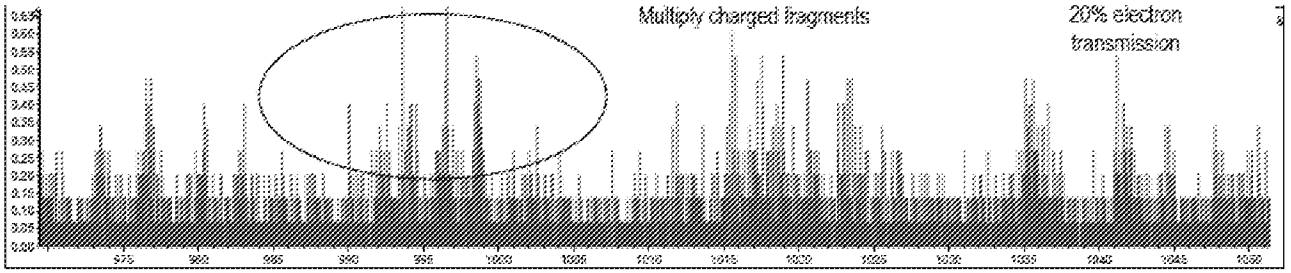
FIG. 8A shows an ECD spectrum of Ubiquitin obtained using an ECD module according to the present teachings with 20% electron transmission.
Figure 8B:
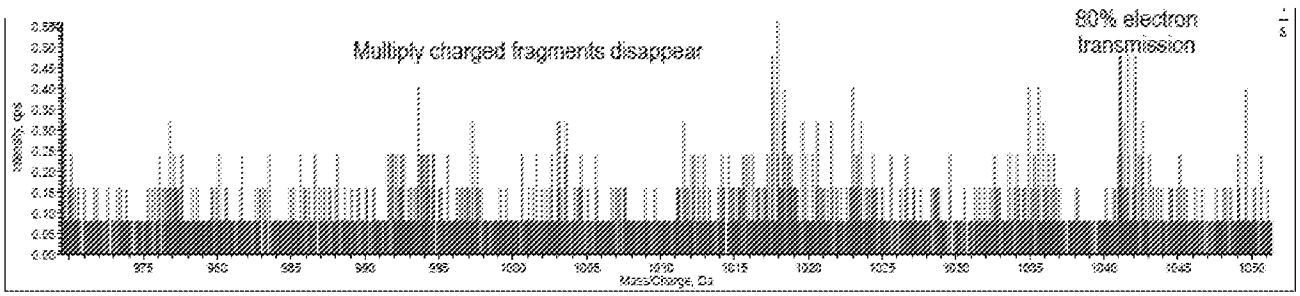
FIG. 8B shows an ECD spectrum of Ubiquitin obtained using an ECD module according to the present teachings with 80% electron transmission.

FIG. 8A shows the ECD spectrum of Ubiquitin obtained for electron transmission of 20% and FIG. 8B shows the ECD spectrum of Ubiquitin obtained for electron transmission of 80%. Although the statistics is insufficient for good ECD spectra in both cases, multiply charged fragments observed in the spectrum obtained with electron transmission of 20% disappear in case of overexposure to electrons when an electron transmission of 80% is employed.

Those having ordinary skill in the art will appreciate that various changes can be made to the above embodiments without departing from the scope of the invention.

What is claimed is:

1. An electron-ion reaction module of an analyte for use in a mass spectrometer, comprising:

a chamber, an electron source for generating electrons and introducing said electrons into the chamber, a gate electrode positioned relative to the electron source and the chamber, a DC voltage source operatively coupled to said gate electrode for applying control voltages to said gate electrode, and a controller operably coupled to said DC voltage source and configured for adjusting the DC voltage applied to the gate electrode to adjust flow of electrons into the chamber; and wherein calibration curves are utilized to determine optimal electron exposure for a given analyte.

2. The electron-ion reaction module of claim 1, wherein said controller adjusts the DC voltage applied to the gate electrode by switching the DC voltage between a plurality of discrete voltage levels.

3. The electron-ion reaction module of claim 2, wherein one of said discrete voltage levels corresponds to a state of the gate (herein "on-state") during which the gate allows introduction of the electrons into said chamber and another one of said discrete voltage levels corresponds to another state of said gate (herein "off-state") during which the gate inhibits introduction of the electrons into said chamber.

4. The electron-ion reaction module of claim 3, wherein said controller adjusts periodicity of said "on" and "off" voltages so as to adjust electron current introduced into said chamber.

5. The electron-ion reaction module of claim 2, wherein said controller switches the DC voltage applied to the gate electrode between said discrete levels at a switching frequency equal to or less than about 100 kHz.

6. The electron-ion reaction module of claim 5, wherein said switching frequency is in a range of about 100 Hz to about 100 kHz.

7. The electron-ion reaction module of claim 2, wherein said discrete voltage levels are in a range of 0 volt to about 100 volts.

8. The electron-ion reaction module of claim 2, wherein said controller adjusts the DC voltage applied to the gate electrode so as to achieve at least 50% fragmentation of ions in the chamber capturing the electrons.

9. The electron-ion reaction module of claim 1, wherein said electron-ion reaction module comprises a first inlet port for receiving said ions and a second inlet port for receiving the electrons.

* * * * *